US005427013A

United States Patent [19]

Kobrehel et al.

[11] Patent Number: 5,427,013

[45] Date of Patent: Jun. 27, 1995

[54] VACUUM MOTOR

[75] Inventors: Michael D. Kobrehel, Elkhart, Ind.; Jeffrey T. Markovicz, White Lake, Mich.

[73] Assignee: Excel Industries, Inc., Elkhart, Ind.

[21] Appl. No.: 181,814

[22] Filed: Jan. 18, 1994

[51] Int. Cl.[6] ..... F01B 19/00

[52] U.S. Cl. ..... 92/40

[58] Field of Search ..... 92/34, 36, 40, 98 D, 92/96, 99, 101, 102

[56] References Cited

U.S. PATENT DOCUMENTS

| | | | |
|---|---|---|---|
| 2,561,957 | 7/1951 | Teague | 92/34 |
| 3,073,348 | 1/1963 | Allen | 92/40 |
| 3,166,658 | 1/1965 | Jennings | 92/34 |
| 3,613,513 | 10/1971 | Johnson | 92/48 |
| 3,999,449 | 12/1976 | Chana et al. | 92/36 X |
| 4,056,043 | 11/1977 | Sriramamurty | 92/99 X |
| 5,249,508 | 10/1993 | Hasgawa et al. | 92/99 X |

FOREIGN PATENT DOCUMENTS

| | | | |
|---|---|---|---|
| 0206593 | 2/1984 | Netherlands | 92/34 |

*Primary Examiner*—Edward K. Look
*Assistant Examiner*—Hoang Nguyen
*Attorney, Agent, or Firm*—Allegretti & Witcoff, Ltd.

[57] ABSTRACT

An improved vacuum motor for actuating heat, ventilating and air conditioning control systems (HVAC), which uses a conical spiral spring and a bonded connection between the housing and cap to reduce weight, size, cost and noise. The motor includes a bellows which forms an airtight compartment inside the motor housing with the cap and a plunger connected to the bellows. The conical spring biases the bellows to a fully expanded position. A negative pressure or vacuum in the air line connected to the housing causes the bellows to collapse and compress the spring. As the bellows collapses, the attached plunger is pulled axially into the motor housing. The movement of the plunger actuates the connected HVAC device.

10 Claims, 3 Drawing Sheets

VACUUM MOTOR

FIELD OF THE INVENTION

This invention relates to a vacuum motor and will have application to an improved vacuum motor which can be used to actuate heating, ventilating, and air conditioning controls.

BACKGROUND OF THE INVENTION

Vacuum motors are used for actuating valves or vents in heating, ventilating and air conditioning (HVAC) control systems in motor vehicles, and various other applications. Vacuum motors, such as the one described in U.S. Pat. No. 3,613,513 to Johnson, transfer vacuum pressure into linear motion. Typically, a vacuum motor includes a housing and a reciprocal plunger, which is connected generally by a linkage mechanism to a vent or other HVAC device for actuation. A collapsible bladder or bellows is connected to the plunger within the motor housing. The bellows forms an airtight compartment in the housing. A helical or cylindrical spiral spring is used to bias the bellows to a fully expanded position. The motor is connected to the air line of the HVAC control system. A negative pressure or vacuum in the air line causes the bellows to collapse and compress the spring. As the bellows collapses, the attached plunger is pulled axially into the motor housing. The movement of the plunger shifts the connected vent or otherwise actuates the connected HVAC device. When the pressure within the bellows is equalized through the air line, the spring tension expands the bellows to extend the plunger. The extension of the plunger returns the connected vent to its original position or further actuates the HVAC device.

Improvements in vacuum motors have centered around attempts to reduce the size of the motor housings without decreasing the operational stroke of the plungers. Conventional vacuum motors are usually constructed of metal, which is costly, relatively heavy, and difficult to fabricate and assemble. Reducing the size of the housings can reduce the production costs of the motors. The dimensions of conventional housings are limited in part by the dimension of the cylindrical spiral springs used to bias the bellows. In a cylindrical spiral spring, each turn or coil of the spring overlies another. When the spring is fully compressed, its coils abut against each other. Consequently, the minimum collapsed height of a spring is limited to the band width of each coil multiplied by the number of coils in the spring. This minimum collapsed height of the spring adds additional size to the motor housing without any increase to the operational stroke of the plunger. Typically, the solution to this dimension problem was to use cylindrical springs with high spring coefficient (K) values and fewer coils. Decreasing the number of coils decreases the life of the motor and increases various other operational problems. For example, springs with fewer coils tend to bow outwardly during compression. Such bowing of the springs force the bellows' side walls into contact with the side walls of the housing. This contact increases the operational noise of the motors and may damage the bellows.

SUMMARY OF THE INVENTION

The vacuum motor of this invention uses a conical spiral spring to reduce the length of the housing without affecting the available stroke length of the plunger. A conical spiral collapses into itself and has generally a minimum collapsed height of a single band width of one coil. Consequently, the size of the housing can be significantly reduced, thereby reducing the cost of the vacuum motor. In addition, the vacuum motor uses a non-metal design which reduces the number of motor components and fabrication costs. The motor incorporates a snap fit plunger construction. The non-metal construction and conical spring use also reduce the noise created by the operation of the motor.

Accordingly, an object of this invention is to provide for a novel and unique vacuum motor.

Another object is to provide for an improved vacuum motor that uses a conical spring to reduce the size of the motor housing.

Another object is to provide for an improved vacuum motor which incorporates non-metal components with an integral snap fit construction for easy assembly and reduction in the motor's expense, weight and operational noise.

Other objects will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

Figure 1:
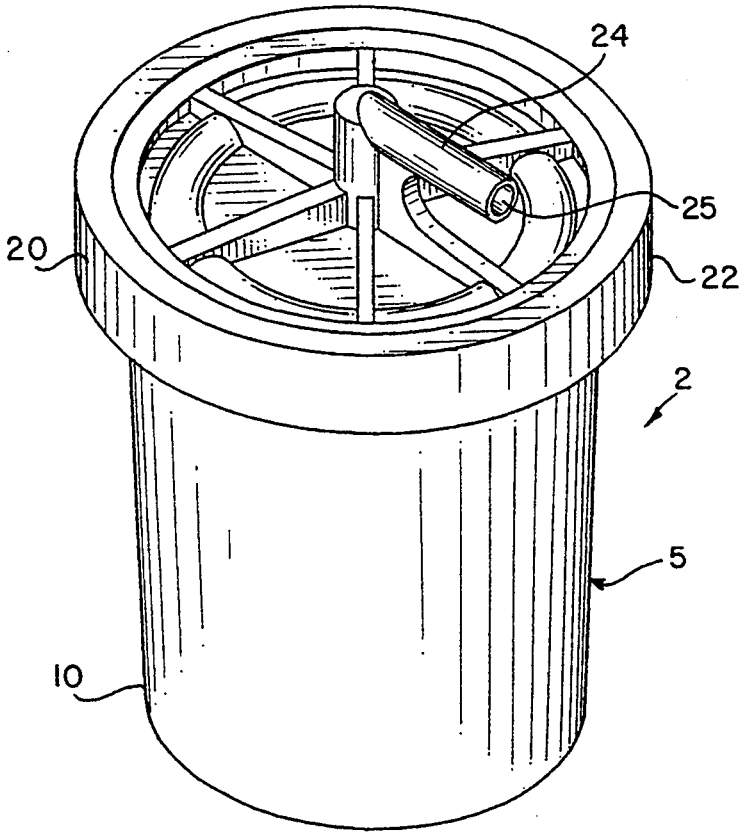
FIG. 1 is a perspective view of the vacuum motor.
Figure 2:
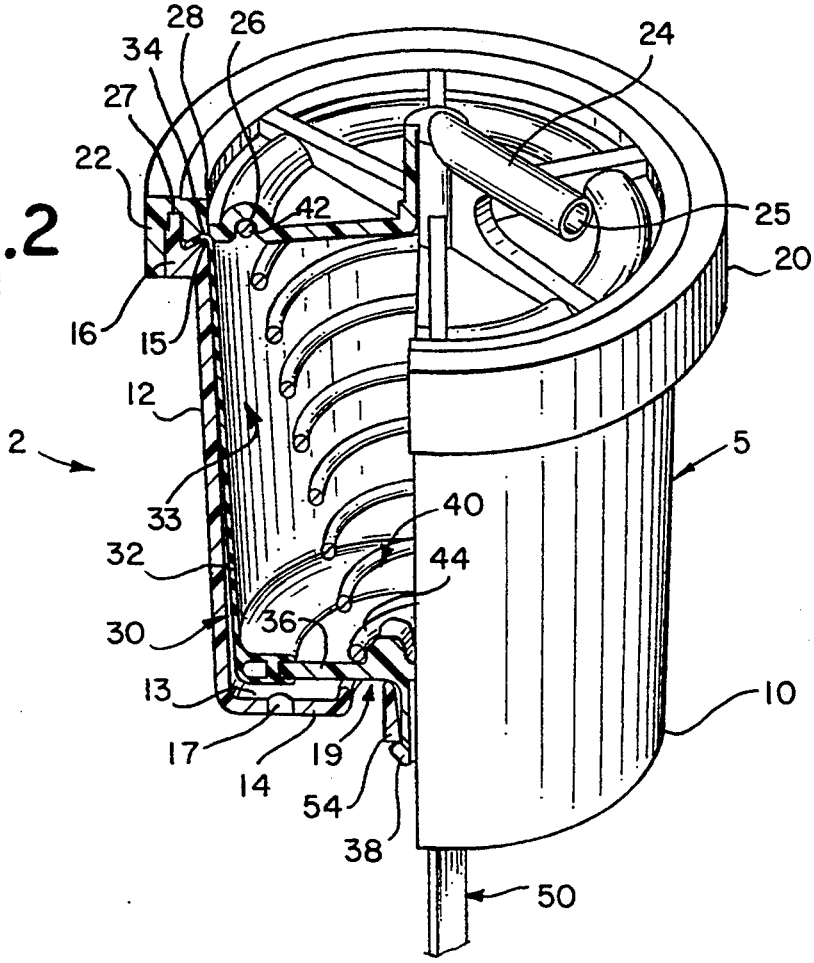
FIG. 2 is a perspective view of the vacuum motor with a quarter section cut away for illustrative purposes to reveal the motor's internal structure.

The preferred embodiment herein described is not intended to be exhaustive or to limit the invention to the precise form disclosed. It is chosen and described to explain the principles of the invention and its application and practical use to enable others skilled in the art to utilize its teachings.

FIGS. 1–4 illustrate vacuum motor 2. Motor 2 includes four basic components: housing 5 having a body 10 and cap 20; a bladder or bellows 30; a conical spiral spring 40; and a plunger 50.

Body 10 and cap 20 are constructed from a suitable light weight material, preferably a thermoplastic. Body 10 includes a cylindrical side wall 12 and a bottom wall 14 which define a cylindrical housing cavity 13. Body side wall 12 has at its open end an outturned annular shoulder 15 which terminates in a projecting annular lip 16 paralleling the side wall. End wall 14 has a plurality of peripherally located holes 17 for venting the housing cavity 13 to ambient pressure and a central plunger opening 19. End wall 14 also includes a raised lip 18 around plunger opening 19.

Figure 3:
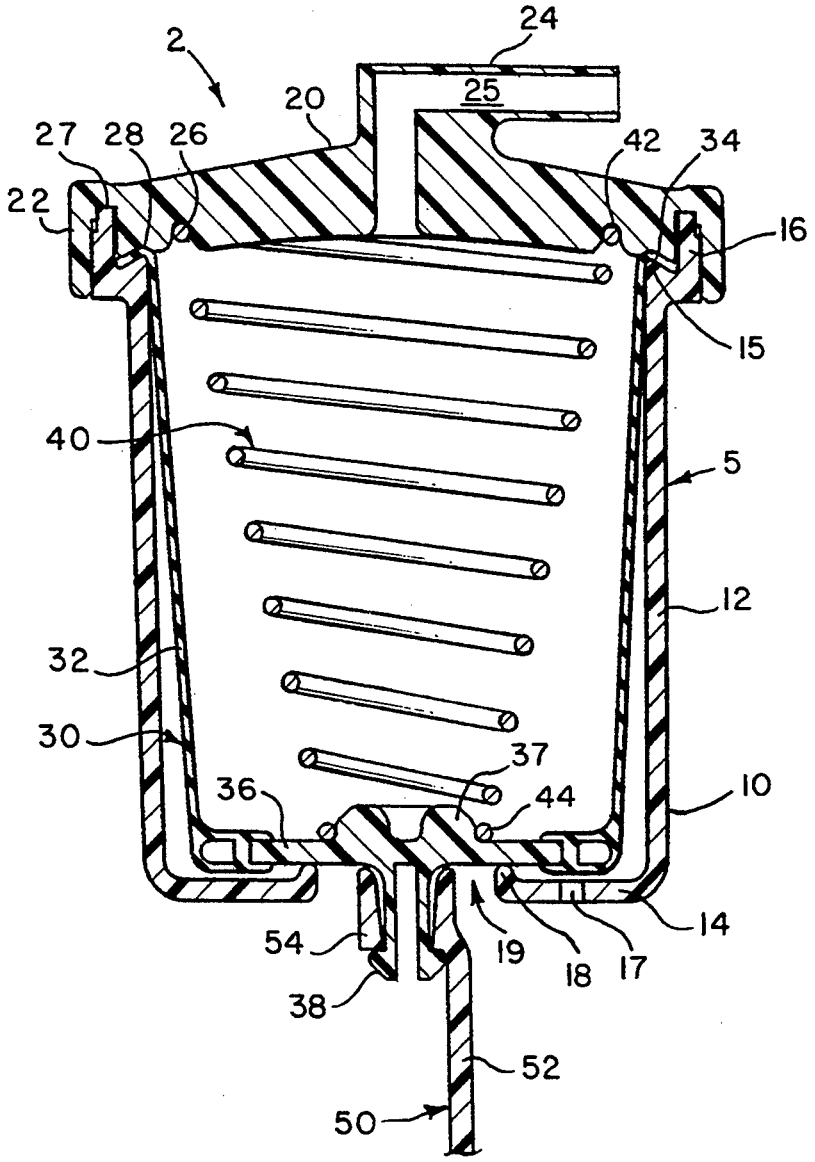
FIG. 3 is a longitudinal sectional view of the vacuum motor taken along line 3—3 of FIG. 1 showing its bellows in a fully expanded position.
Figure 4:
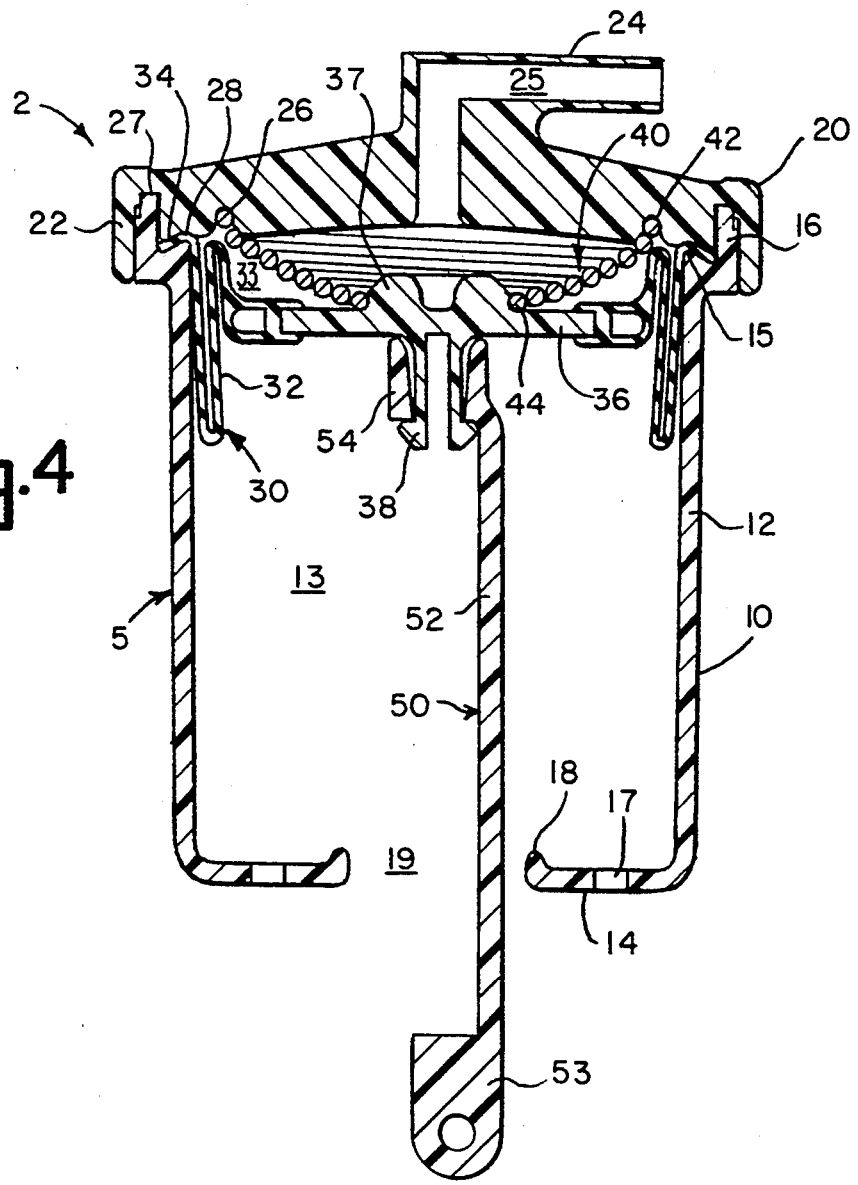
FIG. 4 is a sectional view of the vacuum motor showing its bellows in a fully collapsed position.

Cap 20 includes an outer annular rim 22 and a central port 24 defining an air passage 25, as best shown in FIGS. 3 and 4. When motor 2 is in operation, port 24 is connected to a conventional vacuum line or tube (not shown). The inner face of cap 20 has an annular inner groove 26 and has at rim 22 a generally concentric outer groove 27. Between grooves 26, 27 is an annular concave land 28. The diameter of cap groove 27 approximates the diameter of body flange 16, such that body flange 16 can be fitted within groove 27 when cap 20 is applied over and secured to the body 10.

Bellows 30 has a flexible generally cylindrical side wall part 32, preferably constructed of a synthetic rubber, such as ethylene-propylene terpolymer (EPDM), and a rigid disc-shaped end part 36, preferably constructed of a thermoplastic. Bellows side wall part 32 terminates at one end in a circumferential flange 34. Side wall part 32 fits in a constructive air tight manner at its opposite end around end part 36 to form an inner wall for bellows 20. End part 36 includes a raised annular ring 37 which protrudes into the interior of bellows 20 and a split male connection part 38 which protrudes outwardly of the bellows.

Conical spiral spring 40 is located in the sealed compartment 33 formed by body 10 and cap 20. Spring 40 can be constructed of any suitable material, preferably spring metal and may have any number of turns or coils with any desired spring constant value. Spring 40 is oriented in an inverted orientation with the base coil 42 of spring 40 seated within cap inner annular groove 26 and its vertex coil 44 seated about annular ring 37 of bellows end part 36. The length of spring 40 is at least equal to the length of bellows side wall part 32.

Plunger 50 is also preferably constructed of a thermoplastic and has an elongated shank 52 adapted for connection to a vent or other HVAC control device to be actuated (not shown). As shown, plunger 50 includes a collar or female connection part 54 at one end of shank 52. Female connection part 54 is snap fitted over male connection part 38 to secure plunger 50 to bellows end part 36. With bellows 30 retained in housing cavity 13, plunger shank 52 extends through plunger opening 19. The opposite end of plunger shank 52 includes a conventional connection part 53 for connection to any of a variety of HVAC control devices.

Motor 2 is assembled using an interlocking component connection or snap fit construction for quick assembly. The assembly of the motor is as follows: Plunger 50 is inserted in interlocking engagement over male connection part 38 of bellows 30. Bellows 30 and plunger 50 are then inserted through the open end of body 10 with plunger 50 extending through plunger opening 19 and bellows flange 34 abutting against body shoulder 15. Spring 40 is inserted in bellows 30 and seated about annular ring 37. Cap 20 is fitted in an interlocking engagement over body 10 with body lip 16 fitted into cap groove 27 and spring 40 seated in annular groove 26 of cap 20. Cap rim 22 is sonically welded to body flange 16 to seal the connection between body 10 and cap 20. When cap 20 is fitted over body 10, bellows flange 34 is compressed between cap land 28 and body shoulder 15 to form the hermetic sealed bellows compartment 33 inside of the bellows within housing cavity 13.

FIG. 3 shows motor 2 with its bellows 30 expanded and its plunger 50 in its fully expended position. Spring 40 urges bellows end part 36 into contact with body lip 18 to limited one direction of travel of plunger 50. FIG. 4 shows motor 2 with its bellows 30 collapsed and its plunger 50 in its fully retracted position within housing cavity 13. A negative pressure or vacuum drawn within bellows compartment 33 through cap port 24 collapses bellows 30 and compresses spring 40. As bellows 30 collapses, end part 36 of bellows 30 is drawn towards cap 20, folding side wall 32 around the end part. This movement of end part 36 pulls plunger 50 linearly into housing cavity 13. When the vacuum is eliminated and the pressure inside compartment 33 begins to equalize with the ambient pressure, spring 40 expands and urges end part 36 towards body bottom wall 12. In this manner, plunger 50 is thus extended. The movement or throw of the plunger can be varied between the fully extended position shown in FIG. 3 and the fully retracted position shown in FIG. 4 by regulating the pressure within the bellows compartment 33.

It is understood that the above description does not limit the invention to the details given, but may be modified within the scope of the following claims.

We claim:

1. A vacuum motor comprising:

a housing having an interior cavity, bellows means disposed within said cavity for forming a compartment within said cavity, said bellows means being responsive to internal pressure within said compartment and shiftable between an expanded position and a collapsed position, including a male connector part, passage means defined in said cap part in communication with said compartment for allowing the creation of a vacuum within said bellows compartment to shift said bellows means from its said expanded position towards its said collapsed position, a spiral spring disposed within said compartment and in compressive engagement between said housing and said bellows means, said spring constituting means for urging said bellows means into its said expanded position, and a plunger connected to said bellows means and shiftable between an extended position wherein said plunger is extended from said housing when said bellows means is in its said expanded position and a retracted position wherein said plunger is in a retracted position within said housing when said bellows means is in its said collapsed position, said plunger including a female connector part and said male part being inserted into said female connector part.

2. The motor of claim 1 wherein said housing includes a body part and cap part, said body part including a cylindrical side wall and an end wall defining a part of said cavity, said cap part connected to said housing to enclose said cavity.

3. The motor of claim 2 wherein said cap part has an annular recess and a annular rim, said body part has a lip fitted within said annular recess and connected to said annular rim.

4. The motor of claim 2 wherein said bellows means is compressed in sealed engagement between said cap part and said body, said passage means is defined in said cap part.

5. A vacuum motor comprising:

a housing having an interior cavity, a body part and cap part, said body part including a cylindrical side wall, a shoulder and an end wall defining a part of said cavity, said cap part having a land and being connected to said housing to enclose said cavity and having an annular recess and an annular rim, said body part having a lip fitted within said annular recess and connected to said annular rim:

bellows means disposed within said cavity, compressed in sealed engagement between said cap part and said body part, for forming a compartment within said cavity, said bellows means having a flange compressed between said shoulder and said land, being responsive to internal pressure within said compartment and shiftable between an expanded position and a collapsed position;

passage means within said housing in communication with said compartment for allowing the creation of a vacuum within said bellows means compartment to shift said bellows means from its said expanded position toward its said collapsed position:

a spiral spring disposed within said compartment and in compressive engagement between said housing and said bellows means, said spring constituting means for urging said bellows means into its said expanded position; and a plunger connected to said bellows means and shiftable between an extended position wherein said plunger is extended from said housing when said bellows means is in its said expanded position and a retracted position wherein said plunger is in a retracted position within said housing when said bellows means in its said collapsed position.

6. The motor of claim 4 wherein said spring is positioned between said cap part and said bellows means.

7. The motor of claim 6 wherein said cap part has an annular recess, said bellows means including a raised ring part, one end of said conical spring seated within said cap recess, the opposite end of said conical spring seated about said bellows ring part.

8. A vacuum motor comprising:

a housing having an interior cavity, bellows means disposed within said cavity for forming a compartment within said cavity, said bellows means having a male connector part and being responsive to internal pressure within said compartment and shiftable between an expanded position and a collapsed position, passage means within said housing in communication with said compartment for allowing the creation of a vacuum within said bellows means compartment to shift said bellows means from its said expanded position towards its said collapsed position, a spring disposed within said compartment and in compressive engagement between said housing and said bellows means, said spring constituting means for urging said bellows means into its said expanded position, and a plunger connected to said bellows means and shiftable between an extended position wherein said plunger is extended from said housing when said bellows means is in its said expanded position and a retracted position wherein said plunger is in a retracted position within said housing when said bellows means is in its said collapsed position, said plunger including a female connector part, said male part being inserted into said female connector part, said housing includes a body part and cap part, said body part including a cylindrical side wall and an end wall defining a part of said cavity, said cap part connected to said housing to enclose said cavity, said bellows means is compressed in sealed engagement with said cap part to define said compartment, said passage means in said cap part.

9. The motor of claim 8 wherein said spring is a conical spiral coil spring.

10. A vacuum motor comprising:

a housing having an interior cavity;

bellows means disposed within said cavity for forming compartment within said cavity, said bellows means including a raised ring part and being responsive to internal pressure within said compartment and shiftable between an expanded position and a collapsed position;

passage means within said housing in communication with said compartment for allowing the creation of a vacuum within said bellows means compartment to shift said bellows means from its said expanded position towards its said collapsed position;

a spring disposed within said compartment and in compressive engagement between said housing and said bellows means, said spring constituting means for urging said bellows into its said expanded position, one end of said spring seated within said cap recess, the opposite end of said spring seated about said bellows means ring part; and a plunger connected to said bellows means and shiftable between an extended position wherein said plunger is extended from said housing when said bellows means is in its said expanded position and a retracted position wherein said plunger is in a retracted position within said housing when said bellows means is in its said collapsed position;

said housing including a body part and cap part, said body part including a cylindrical side wall and an end wall defining a part of said cavity, said cap part being connected to said housing to enclose said cavity, said bellows means being compressed in sealed engagement with said cap part to define said compartment, and said passage means being in said cap part.

* * * * *